US005375306A

United States Patent [19]

Roussin-Moynier

[11] Patent Number: 5,375,306

[45] Date of Patent: Dec. 27, 1994

[54] METHOD OF MANUFACTURING HOMOGENEOUS NON-WOVEN WEB

[75] Inventor: Yves Roussin-Moynier, Wintzenheim, France

[73] Assignee: Kaysersberg, Kaysersberg, France

[21] Appl. No.: 852,262

[22] PCT Filed: Oct. 4, 1991

[86] PCT No.: PCT/FR91/00783

§ 371 Date: Jun. 8, 1992

§ 102(e) Date: Jun. 8, 1992

[87] PCT Pub. No.: WO92/06237

PCT Pub. Date: Apr. 16, 1992

[30] Foreign Application Priority Data

Oct. 8, 1990 [FR] France ..... 90 12348

[51] Int. Cl.[5] ..... D04H 1/44

[52] U.S. Cl. ..... 28/104; 264/121; 264/122; 19/296; 156/202

[58] Field of Search ..... 28/103, 104, 105, 106; 264/119, 121, 122, 6; 156/220, 167; 19/296, 300

[56] References Cited

U.S. PATENT DOCUMENTS

| | | | |
|---|---|---|---|
| 2,357,392 | 9/1944 | Francis, Jr. | 264/6 |
| 2,464,301 | 3/1949 | Francis, Jr. | 156/202 X |
| 4,442,161 | 4/1984 | Kirayoglu et al. | 28/104 X |
| 4,555,430 | 11/1985 | Mays | 28/104 X |
| 4,661,132 | 4/1987 | Thornton et al. | 156/167 X |
| 4,767,586 | 8/1988 | Radwanski et al. | 264/121 X |
| 4,775,579 | 10/1988 | Hagy et al. | 28/104 X |
| 4,808,467 | 2/1989 | Suskind et al. | 28/104 X |
| 4,902,564 | 2/1990 | Israel et al. | 28/104 X |
| 4,931,355 | 6/1990 | Radwanski et al. | 28/104 X |
| 4,997,607 | 3/1991 | Nopper et al. | 264/122 X |
| 5,017,312 | 5/1991 | Peters et al. | 19/296 X |
| 5,023,027 | 6/1991 | Nopper | 264/119 X |
| 5,088,910 | 2/1992 | Goforth et al. | 264/122 X |
| 5,227,224 | 7/1993 | Ishikawa et al. | 28/104 X |
| 5,229,052 | 7/1993 | Billiu | 264/121 X |
| 5,240,764 | 8/1993 | Haid et al. | 28/104 X |

*Primary Examiner*—Clifford D. Crowder
*Assistant Examiner*—John J. Calvert
*Attorney, Agent, or Firm*—Breiner & Breiner

[57] ABSTRACT

The invention relates to a method for forming a hydraulically bound web. A homogeneous mixture of wood pulp and synthetic fibers is blown on a forming surface. The web has a mixture of at least 70% wood pulp by weight of the mixture. The web is subjected to hydraulic bonding to form a stable fabric. The web is further heated to a temperature to cause partial melting of the synthetic fibers and further bonding of the fabric.

7 Claims, 2 Drawing Sheets

E21A
E22A
E23A
TEAR RESISTANCE gf/5cm
8,000
7,000
6,000
5,000
4,000
3,000
2,000
1,000
0
DRY
MOIST
DRY
MOIST
SM
ST
DIRECTION OF ADVANCE
TRANSVERSE DIRECTION

OR
2
3
4
5
6
8
10
20
21
22
24
25
26
27
28
29
30
31
40
61
62
63
65
66

METHOD OF MANUFACTURING HOMOGENEOUS NON-WOVEN WEB

The invention concerns an absorbing web, i.e., a non-woven product constituted on the whole by short absorbing fibers, such as from wood pulp, and by longer synthetic fibers. The web is produced by hydraulic bonding.

As regards a current technique for making paper-fiber based products, an aqueous fiber suspension is prepared from which a sheet is then made. Depending on the kind of fibers and the processing of the sheet, various grades of papers are obtained, among which is cellulose wadding. It is widely used in households for sanitary uses, as towels, etc. However, cellulose wadding is mechanically weak, especially when moist, and therefore it is unsuitable for industrial or household mopping.

In another and so-called dry technique, illustratively described in British Patent No. 2,015,604 (Kroyer), the fibers are suspended in a gas flow and then deposited in layer form on a permeable cloth. The low moisture precludes inter-fiber bonding. A binder must be added, as a rule a latex, to make the layer cohesive. In such manner, a product with improved tear resistance over conventional paper is produced which also is quite absorbing. The applications of this product essentially are the same as for the former one. However, incorporating a binder, such as a latex, also entails drawbacks. Illustratively, it increases product stiffness and it may react chemically with the fluids it may come in contact with. This is the case in particular when it is desired to make linen impregnated with a liquid such as skin-lotion or the like.

Instead of using a chemical binder, thermoplastic synthetic fibers have already been suggested to be incorporated into the layer of absorbing fibers to serve as thermally activated binders. Illustratively, European Patent Application No. 070164 (Chicopee) describes an absorbing web that is thermally bound and of which the low density, namely less than 0.15 g/cm$^3$ (0.06 g/cm$^3$ in the described embodiments), is composed of paper-type absorbing fibers mixed with two conjugate component synthetic fibers, namely polyethylene and polyester. The manufacturing procedure is to prepare a layer from a homogeneous mixture of absorbing and of conjugate fibers; and then heat-processing it in bulk at low pressure and at sufficient temperature to melt the polyethylene that is present at the surface of the synthetic fibers, but not the polyester. Thereby, following cooling, a low-density web is obtained of which the synthetic component has retained its fiber nature. The preservation of the integrity of the synthetic fibers is an important factor in this patent in order to make a high volume-to-mass product with high absorption. Consequently, the applications considered therein are notably in personal hygiene and menstrual napkins for instance. However, post-strengthening (calendering, crinkling) appears required when this web must be used for wiping or mopping, for example where the mechanical stresses are larger.

European Patent Application No. 0326771 (James River) describes a resistant and absorbing fabric composed of paper-pulp and of textile fibers, and which is free of any binder. This fabric is made from one or more webs previously formed in the papermaking wet way and consisting of a homogeneous mixture of fibers containing 50 to 75% by weight wood pulp, and 25 to 50% by weight textile-length synthetic fibers. The webs, moreover, were subjected to water-jet bonding treatment known per se and with sufficient energy to form a relatively dense uniform non-woven with good inter-fiber cohesion.

Further, U.S. Pat. No. 4,442,161 (Kirayoglu) discloses a manufacturing method of a web bonded by water jets and consisting of wood-pulp and synthetic fibers. The bonding is carried out in particular from synthetic fibers in the form of a non-woven web of continuous fibers and of wood-pulp fibers in the form of a paper sheet. The treatment takes place under conditions allowing enhancing of the liquid-barrier properties of the web, in particular for use as sheeting for medical or surgical purposes.

The object of the invention is a method of manufacturing a web consisting of wood-pulp and of synthetic fibers carried out by water-jet bonding treatment. The invention is characterized in that the water-jet bonding treatment is carried out on a duct-blown, that is a so-called aeraulic layer, consisting of a homogeneous mixture of unbonded wood-pulp and synthetic fibers.

Contrary to the case of the prior art consisting of non-woven webs previously bonded, it was discovered that by applying the method of the invention it is possible to achieve a product with good tear resistance both when moist and dry, and with a good absorption rate.

The layer is formed by any conventional procedure known to the expert. In such conventional manner, measured amounts on the one hand of synthetic fibers are prepared by being opened or individualized, and on the other hand of paper fibers made by dry grinding wood pulp are prepared. Thereupon, the fibers are pneumatically carried in suspension in an air flow to a forming head of the layer starting with which the fibers are uniformly deposited on a support cloth moving continuously at a specified speed.

Preferably this mixture shall comprise at least 70% by weight wood-pulp fibers, the remainder being synthetic fibers. An advantageous mixture consists of 70 to 90% by weight wood-pulp fibers and 30 to 10% by weight synthetic fibers. If the proportion of synthetic fibers in the mass of wood-pulp fibers is too low, homogeneous dispersion will be difficult to achieve and the specific surface weight of the layer will vary. Moreover, the subsequent bonding will be unsatisfactory. The synthetic fibers may be of different kinds. Preferably, their length shall be less than 20 mm and their titer between 1.2 and 3.3 dtex.

Again water-jet bonding is known per se to the expert. Illustratively, a procedure is described in U.S. Pat. Nos. 3,485,706 (Evans) or 3,560,326 (Brunting). It consists in high-energy fine jets passing through the layer to be treated which is placed on a horizontally displaceable support in the form of a perforated plate or a suitably selected woven cloth. The interlacing of the fibers due to the water-jet action results in the consolidation of the layer and in imparting to it a textile appearance.

The procedure permits producing a web with a specific surface weight of between 20 and 200 g/m$^2$, preferably between 40 and 100 g/m$^2$. Actually the upper limit depends on the ability of the water jets to pass through the layer and to carry out fiber interlacing.

In another implementation of the invention, tear-resistance is further improved by selecting synthetic thermoplastic fibers and in subjecting the web leaving the hydraulic-bonding station to thermal bonding wherein the thermoplastic fibers are molten at least in part so that following cooling there shall be bonding zones between these fibers. Advantageously, these shall be two-component fibers of which the one with the lower melting point is at the surface. The heating temperature is determined to be sufficient to melt the component with the lower melting point while preserving the other from fusion. Thereby these fibers allow a lower thermal bonding temperature and the fiber structure will be preserved.

Accordingly, the method of the invention allows for making an absorbing, tear-resistant product with a textile appearance and of which the surface is lint-free. It can serve as a disposable or short-term product for wiping or mopping in households, industry, or restaurants. Because of the absence of any chemical binder, it may serve as a substrate for impregnation liquids, such as skin lotion, lanolin, wax, etc.; and it may be used as an impregnated linen item. Also, it may be used in medicine, surgery, or for sanitary purposes. Where called for, the web may be subjected to an ultimate chemical or mechanical softening treatment.

Other features and advantages of the invention are elucidated in the following description of an illustrative, but non-limiting embodiment mode of the invention shown in the drawings.

Figures 1, 2:
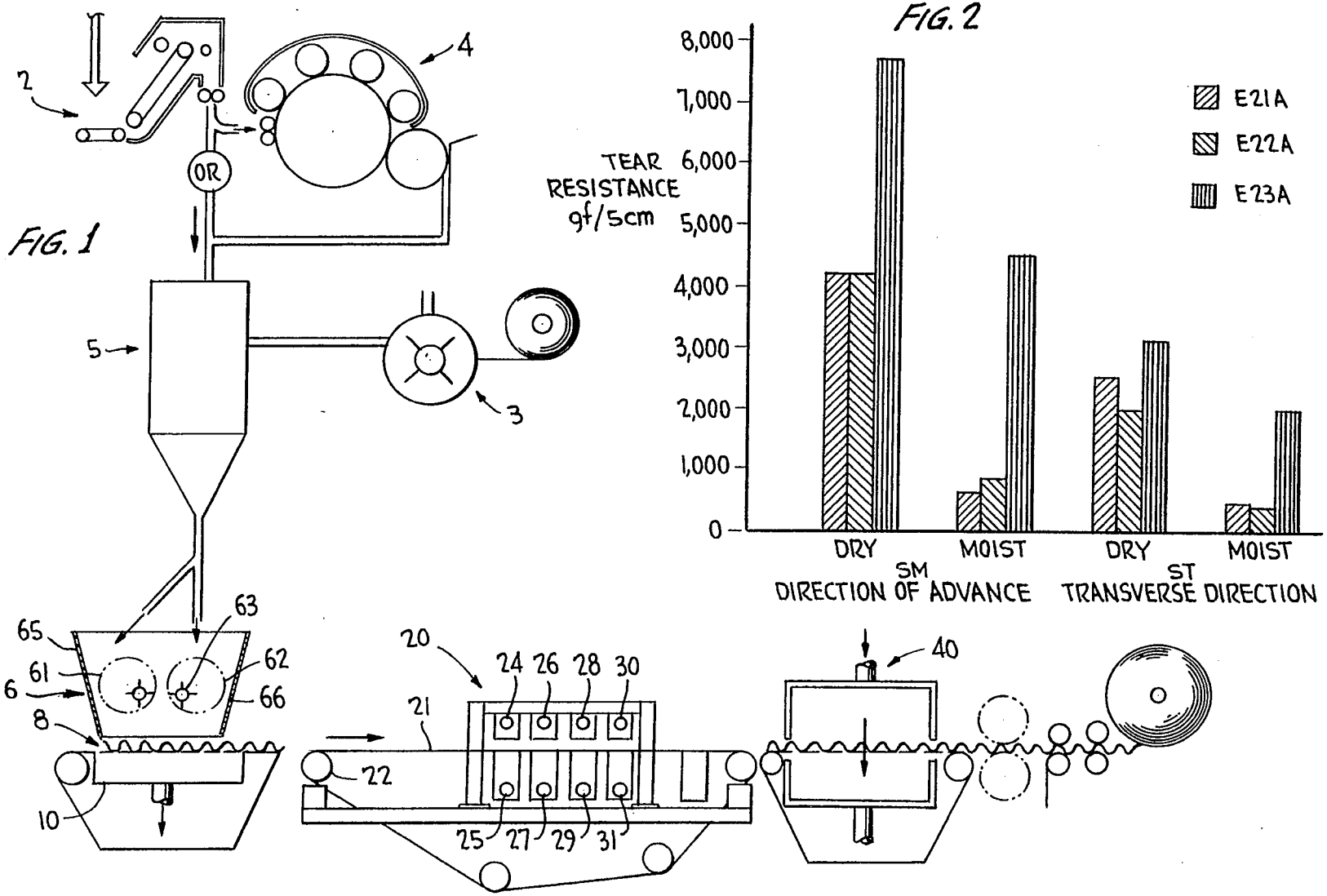
FIG. 1 is equipment for the implementation of the method of the invention.
FIGS. 2 and 3 are plots showing the tear resistance of webs made by the method of the invention.

The equipment shown in FIG. 1 comprises a receiving station 2 for synthetic fibers with a feeder supplying a card 4 which is required when the fibers must be opened. The card, in turn, feeds a mixer 5, for example of the cyclone type. The mixer is supplied with wood-pulp fibers from a dry-grinding paper pulp station 3, the pulp being supplied in sheet rolls. The fibers are thoroughly mixed in the cyclone and in suspension in an air flow which carries them to a head 6 forming the layer.

The equipment may be of the kind described in European Patent Application No. 032772 (Scanweb) or equivalent. Such equipment consists of two parallel, rotating drums 61, 62 with perforated walls transverse to an endless, air-permeable receiving cloth 8. A fiber-agitating rod 63 is present inside each drum and is fitted with fins rubbing against the inside walls of each drum when rotating. The fluidized fiber material is introduced inside the drums 61, 62 through one end and is sucked-in through their perforated wall by means of a partial vacuum from a vacuum box 10 underneath the receiving cloth 8 opposite the forming head 6. The agitating rods assure that the fiber mass moves axially inside the drums and assists in splitting up any aggregations and in moving the fibers through the walls. Sheet metals 65, 66, which are arranged on both sides of the drums, channel the gas flow toward the cloth 8. In this manner the fibers are received on the moving cloth to form a continuous layer driven toward the water-jet bonding station 20.

This bonding station comprises an endless cloth 21 horizontally tensioned between rollers 22, of which at least one is driven by suitable means. The mesh size of the cloth, which is made of metal or plastic filaments, is selected in particular as a function of the texture, whether open or not, which is desired in the web. A continuous perforated sheet also is suitable. The cloth moves the layer through a set of water jets transverse to the advance of the cloth. The number of sets depends on how the pressure levels are selected. In the test run on equipment from PERFOJET, there are four sets. The water jets are generated from tubular feeds 24, 26, 28, 30 mounted above and across the cloth. Each feed supplies a set of 40 to 60 injectors that consists of a plate with calibrated orifices. The feeds are supplied with pressurized water and deliver high-energy water jets onto the fiber layer. After its energy has been spent through the layer, the water is recovered by means of suction boxes 25, 27, 29, 31 which are present underneath the cloth and opposite each set.

Once bonded, the layer is drained of water by being moved over vacuum slits and then enters a drier 40. The drier shown in the figure is a crossing-air oven of which the heating-gas temperature can be adjusted so that besides drying, where called for, the thermoplastic fibers in the layer can be made to fuse.

EXAMPLE 1

Webs of the invention were made from mixtures with different proportions of synthetic fibers (Table I).

TABLE I

| MIXTURES | A | B | C | D | E | F |
|---|---|---|---|---|---|---|
| Wood pulp: | | | | | | |
| ITT Rayonier JLD, untreated | 80% | 70% | | | | |
| Vigor | | | 90% | 80% | 90% | 80% |
| Synthetic fibers: | | | | | | |
| Danaklon ESF, 12 mm | 20% | 30% | | | | |
| Danaklon ESHF, 6 mm | | | 10% | 20% | | |
| Danaklon ESHF, 12 mm | | | | | 10% | 20% |

Danaklon ESF = two-component PE/PP. type side/side, crimped, 12 mm long, 3.3 dtex
Danaklon ESHF 6 mm = two-component PE/PP, type side/side, crimped, 6 mm long
Danaklon ESHF 12 mm = two-component PE/PP, type side/side, crimped, 12 mm long After layers were made of the various mixtures A through F in the manner described above, they were water-jet bonded and then bonded thermally. Table II shows the conditions of this bonding.

TABLE II

| | |
|---|---|
| Support cloth: | Metal mesh (improved interlacing of the layer is assured by the shape and diameter of the metal wires) |
| Speed relative to and underneath the injectors: | 25 m/min |
| Injectors: | 4 injector pumps |
| Orifice diameters: | 100–140 gm |
| Water-jet pressure: (measured at the supply conduit) | 30/50/70/90 bars for mixture A<br>30/60/80/100 bars for mixture B<br>30/40/60/80 bars for mixtures C and E |
| Air temperature in the air-crossed oven | 145 to 150° C. |

The oven heating conditions were selected to allow drying of the web and melting of the polyethylene of the synthetic fibers, though not melting of the polypropylene. In this manner the latter remained intact while bonding the fibers in contact with them.

The tear-resistance and the absorption of the webs made by the method of the invention were measured and are shown in Table III below.

TABLE III

| MIXTURES | A | B | C | D | E | F |
|---|---|---|---|---|---|---|
| Specific surface weight, g/m$^2$ EDANA Test 40.3-89 | 78 | 80 | 68 | 70 | 72 | 70 |
| Thickness, mm EDANA Test 30.4-89 | 0.62 | 0.64 | 0.70 | 0.75 | 0.72 | 0.73 |
| Dry tear-resistance | | | | | | |
| % elongation at gf/5 cm SM* | 7750 25% | 8000 33% | 2800 30% | 4500 35% | 2800 30% | 4800 35% |
| EDANA Test 20.2-89 ST* | 3100 60% | 6000 57% | 1350 60% | 2000 60% | 1450 70% | 2300 60% |
| Wet tear-resistance | | | | | | |
| % elongation at gf/5cm SM | 4500 27% | 6500 38% | 800 30% | 2250 30% | 800 30% | 2500 35% |
| EDANA Test 20.2-89 ST | 2000 60% | 4400 55% | 400 70% | 1050 60% | 400 70% | 1150 60% |
| Absorption EDANA Test 10.1-72 | | | | | | |
| capacity, g/g | 7.4 | 7.2 | | | | |
| time, sec | 1.5 | 2.4 | | | | |

*SM = direction of advance;
ST = transverse direction

The measurements were carried out in accordance with EDANA standards. Illustratively, the tear-resistance test 20.2-89 subjects the web to a constant-speed traction (100 mm/min) with measurement of the maximum load before rupture. The elongation is then measured at the rupture. The absorption test 10.1-72 measures, on the one hand, the time required for the web to become fully impregnated with a liquid, and, on the other hand, the quantity of liquid absorbed within a specified time interval and related to the web weight.

Be it borne in mind that other fibers than those discussed in the example may be used. Among the S/C (sheath/core) type fibers there are the polyethylene/-polyester fibers marketed as Celanese K 56 (uncrimped, 10 mm, 2.2 dtex) or Solstar (uncrimped, 10 mm, 2.2 dtex), and again such polyester/polyester fibers as Dupont 271P (uncrimped, 12 mm, 2.2 dtex), further Unitika Melty (crimped, 10–15 mm, 1.5/2 dtex), also polyethylene/polypropylene fibers such as Daiwabo NBF (uncrimped, 10 mm, 2 dtex). Among the S/S (side/side) fibers, there are also the polyethylene/polypropylene fibers Daiwabo ESF (crimped, 6 mm, 3.3 dtex). Among the single-component fibers, there is a polyethylene Steen Polysteen fiber (uncrimped, 12 mm, 2.8 dtex).

EXAMPLE 2

Three different hydraulic webs were made from each of the mixtures A and B of the preceding Example.

In the first case, merely drying at moderate temperature was carried out to eliminate the water without changing the fiber structure (tests E21A and E21B).

In the second case, the web made by water-jet bonding was calendered, also at moderate temperature (tests E22A and E22B).

In the third case, the conditions of Example 1 were repeated (tests E23A and E23B).

Figure 3:
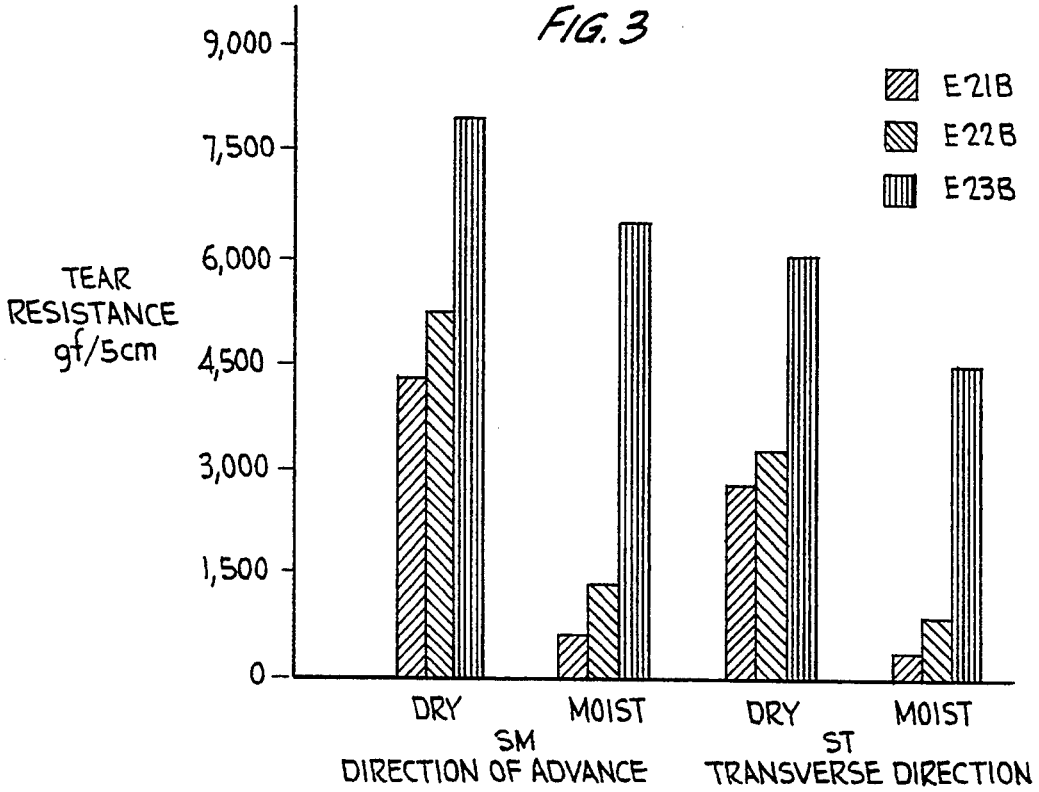

The graphs of FIGS. 2 and 3 show the tear-resistance of a test strip 5 cm wide (gf/5 cm) in the direction of advance SM and in the transverse direction ST, both when dry and when moist. Substantial improvement on account of the thermal treatment is shown up to the melting point.

EXAMPLE 3

Comparison tests were carried out on three webs with the same specific surface weight. The first web E31 was dry-made with the inter-fiber bonding by latex atomization. This web contains 20% by weight binder. The second web E32 was dry-made and bonded by crinkling with a binder consisting of thermoplastic Danaklon ESF fibers (Example 1) present by 20%. The third web E33 was made as in Example 1 with the mixture A.

Figure 4:
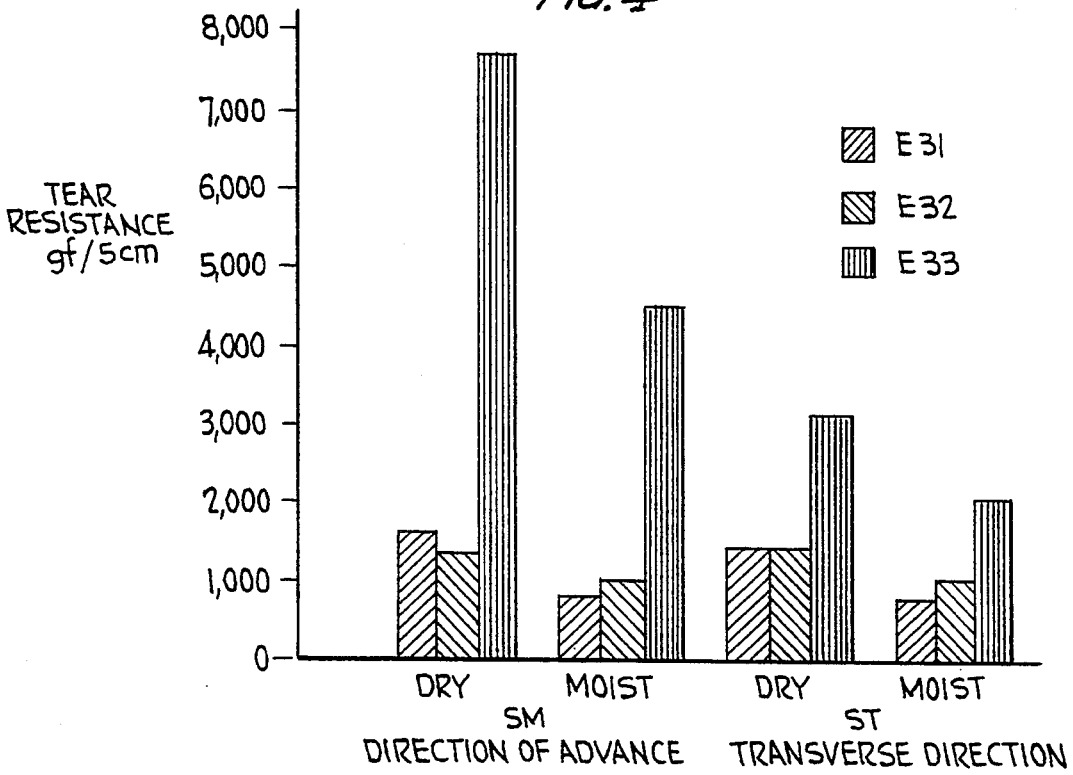
FIG. 4 is a plot showing a comparison test between a dry-made, latex-bound web and a thermally bonded web.

The graph of FIG. 4 shows the tear-resistance in the direction of advance SM and in the transverse direction ST, both for the dry and moist conditions, and that the method of the invention provides webs with much higher performance.

EXAMPLE 4

A comparison test was carried out regarding absorption/retention/resiliency between the webs of Example 1 made by the method of the invention from mixtures D, E and F, and a dry-made web bonded by latex (15%) marketed as Homecel P050.

In particular, the test consists in placing a sample on a plate of porous sintered absorption-glass through which it is moistened. The plate is connected by a hose to a reservoir on a weighing scale and can be moved along a vertical rail. The measurements are the scale's display of weight from which the absorption capacity of the sample can be computed in grams of liquid per gram of sample after a specified time. The initial absorption rate also can be computed.

As regards retention, the sintered glass is moved along the rail in such a way that the sample discharges the liquid because of the partial vacuum created by the level-difference between the glass and the reservoir.

The test shown in Table IV shows that, in particular, the product evinces an excellent initial absorption rate.

TABLE IV

| PRODUCTS | MIXTURE D | MIXTURE E | MIXTURE F | HOMECEL |
|---|---|---|---|---|
| specific surface weight | 75.2 | 72.3 | 68.4 | 50.2 |
| dry bulk (cc/g) | 9.4 | 9.9 | 9.3 | 15.2 |
| absorption (g/g) | 7.3 | 7.3 | 7.3 | 9.4 |
| initial absorption rate (100 × g/g/dry) | 186 | 217 | 230 | 175 |
| retention (g/g) | 4.38 | 4.44 | 4.40 | 5.56 |
| absorption at 10 kPa (g/g) | 5.1 | 5.1 | 5.2 | 4.9 |
| reabsorption (g/g) | 5.9 | 6.0 | 6.0 | 6.8 |
| resiliency % | 17.6 | 16.1 | 16.0 | 30.9 |
| compression % | 31.3 | 33.5 | 30.9 | 54.8 |

I claim:

1. A method for making an absorbent non-woven web of wood pulp fibers and synthetic fibers comprising forming a homogeneous mixture of fibers in a flow of air, said homogeneous mixture of fibers being composed of at least 70% by weight of wood pulp fibers and of at most 30% by weight of synthetic fibers wherein said synthetic fibers are opened and from 6–20 mm in length; conveying said homogeneous mixture of fibers to a forming head and forming a layer of said homogeneous mixture of fibers on a support; and subjecting said layer to water jets in a manner so as to bond said layer.

2. Method defined in claim 1 wherein the synthetic fibers are present in an amount of 10 to 30% by weight.

3. Method defined in claim 1 wherein the synthetic fibers comprise two-component fibers.

4. Method defined in claim 1 wherein the web evinces a specific surface weight of between 20 and 200 $g/m^2$.

5. Method defined in claim 4 wherein the specific surface weight is between 40 and 100 $g/m^2$.

6. Method defined in claim 1 further comprising following the bonding by water jets, heating the web to a sufficient temperature to cause at least partial melting of the synthetic fibers.

7. Method defined in claim 6 wherein the layer comprises two-component synthetic fibers and the temperature is sufficient to melt the component of the two-component synthetic fibers with a lower melting point but not to melt the component with a higher melting point.

* * * * *